US005584157A

United States Patent [19]

Sun

[11] Patent Number: 5,584,157

[45] Date of Patent: Dec. 17, 1996

[54] STRUCTURE OF A DOOR FRAME

[76] Inventor: Hsin Y. Sun, P.O. Box 82-144, Taipei, Taiwan

[21] Appl. No.: 587,986

[22] Filed: Jan. 17, 1996

[51] Int. Cl.[6] ..... E06B 1/04

[52] U.S. Cl. ..... 52/656.4; 52/211; 52/213; 52/204.5; 52/656.9; 49/504; 49/380

[58] Field of Search ..... 52/211, 213, 217, 52/656.4, 656.5, 656.7, 656.1, 656.9, 204.51, 204.591, 204.5; 49/504, 380, 382

[56] References Cited

U.S. PATENT DOCUMENTS

| | | | |
|---|---|---|---|
| 3,774,345 | 11/1973 | Cole et al. | 49/504 |
| 4,614,068 | 9/1986 | Bergthold | 52/656.4 X |
| 4,621,478 | 11/1986 | Phillips et al. | 52/235 X |
| 4,899,507 | 2/1990 | Mairlot | 52/656.5 |
| 4,991,365 | 2/1991 | Jackson | 160/135 X |
| 5,090,168 | 2/1992 | Fast et al. | 52/213 |
| 5,293,723 | 3/1994 | Slessor | 52/656.4 X |

FOREIGN PATENT DOCUMENTS

| | | | |
|---|---|---|---|
| 2150189 | 6/1985 | United Kingdom | 52/204.51 |
| 2153889 | 8/1985 | United Kingdom | 52/211 |

*Primary Examiner*—Carl D. Friedman
*Assistant Examiner*—Winnie Yip
*Attorney, Agent, or Firm*—Alfred Lei

[57] ABSTRACT

A structure of a door frame including four rails each formed with a first passage at one side, a second passage at an intermediate portion, a third passage at another side, a first slot at an edge, a second slot at a front side, a third slot at the front side, a fourth slot at another side, and a raised portion at a rear side, four right-angled connectors formed with a first shoulder at one side, a central block, and a second shoulder at another side adapted to be inserted into the first, second and third passages, four auxiliary locking members each fixedly installed into the third passage and having a slot for passage of electrical wires, four fastening posts each formed with a first groove at one side and a second groove at another side adapted to engage with the raised portion of the rails and right-angled connectors, and covering members arranged on the inner sides of the frame.

1 Claim, 13 Drawing Sheets

STRUCTURE OF A DOOR FRAME

BACKGROUND OF THE INVENTION

1. Field of the Invention

This invention relates to an improvement in the structure of a door frame.

2. Description of the Prior Art

It has been found that the conventional door frames can be roughly divided into five kinds. FIG. 1 illustrates a most commonly used wooden door. However, such a door will corrode and be easily deformed in damp condition. Hence, a door made of fiber reinforced plastic (see FIG. 2) has been developed to obviate these drawbacks, but the door will produce poison gas in case of fire and cannot be recycled. The aluminum door (see FIG. 3) is too dull in appearance and cannot effectively separate sound from one side to the other. FIG. 4 shows a metal door which is too expensive in cost. FIG. 5 illustrates a specially designed wooden door which is inflammable and will easily corrode in damped condition.

Therefore, it is an object of the present invention to provide a structure of a door frame which can obviate and mitigate the above-mentioned drawbacks.

SUMMARY OF THE INVENTION

This invention relates to an improvement in the structure of a door frame.

It is the primary object of the present invention to provide a structure of a door frame which is fit for mass production.

It is another object of the present invention to provide a structure of a door frame which is easy and cheap to assemble.

It is still another object of the present invention to provide a structure of a door frame which is simple and sturdy in construction.

It is still another object of the present invention to provide a structure of a door frame which is durable in use.

It is a further object of the present invention to provide a structure of a door frame which can be placed at the market at a very low cost.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

BRIEF DESCRIPTION OF THE DRAWINGS

FIGS. 13A–13E illustrate different kinds of decorative members.

DETAILED DESCRIPTION OF THE PREFERRED EMBODIMENT

Figure 1:
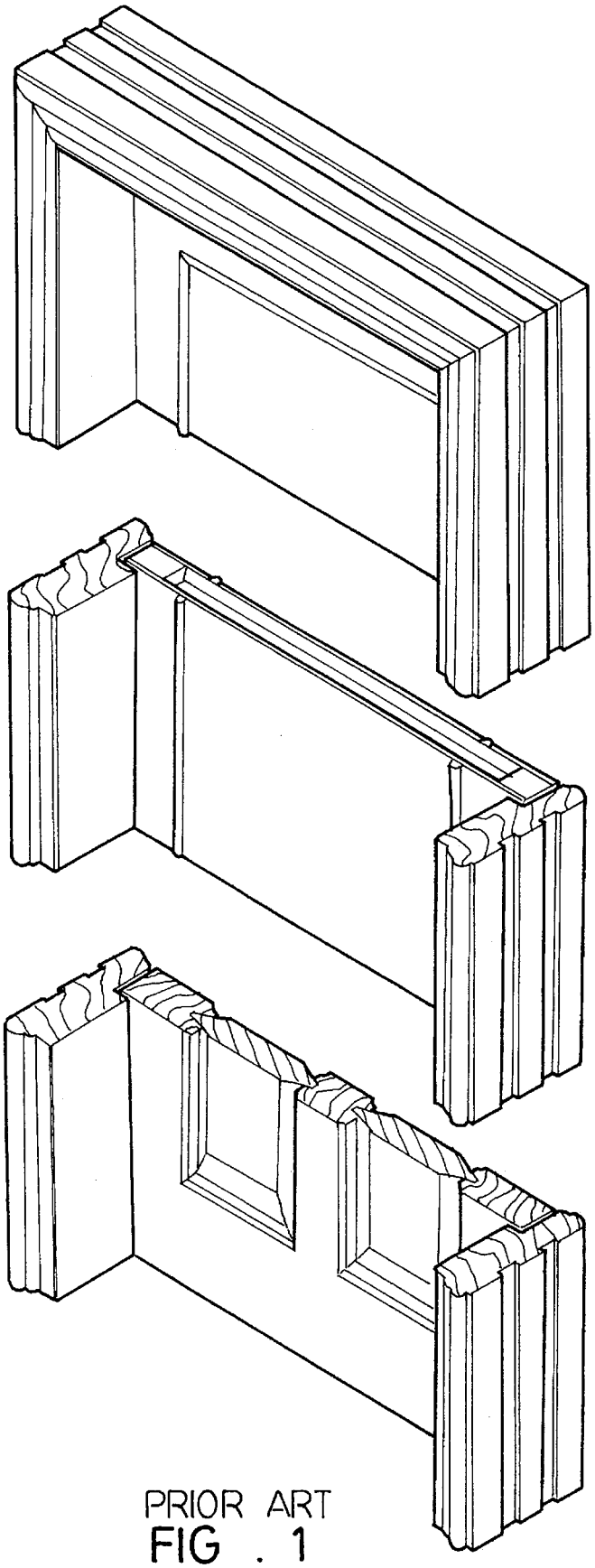
PRIOR ART FIG . 1
FIG. 1 illustrates a first prior art door.
Figure 2:
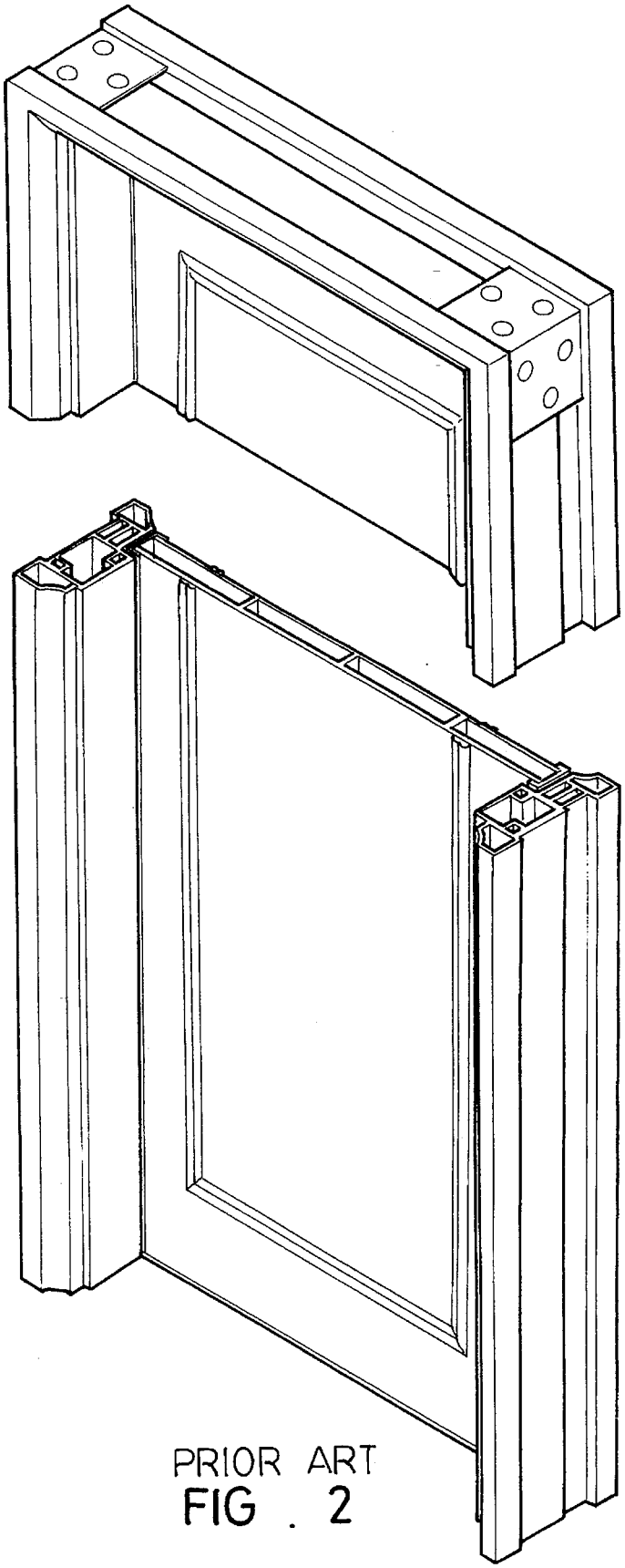
PRIOR ART FIG. 2
FIG. 2 illustrates a second prior art door.
Figure 3:
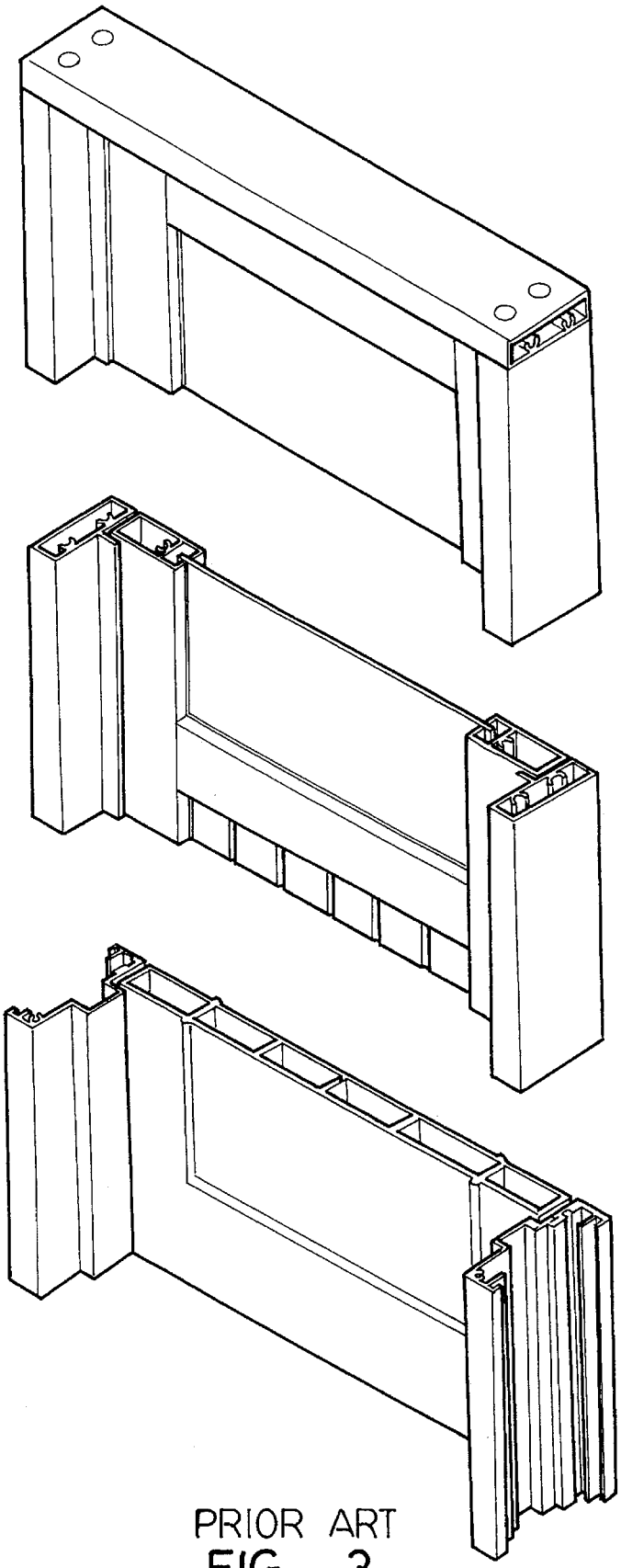
PRIOR ART FIG. 3
FIG. 3 illustrates a third prior art door.
Figure 4:
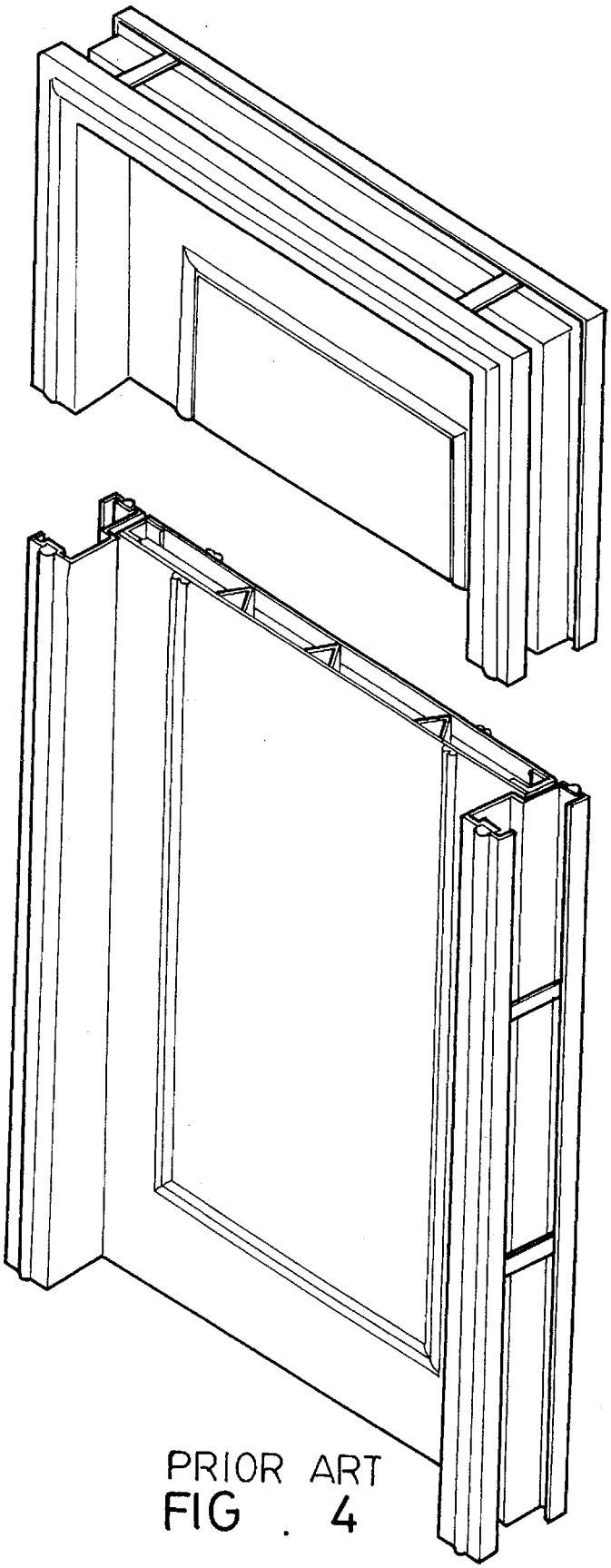
PRIOR ART FIG. 4
FIG. 4 illustrates a fourth prior art door.
Figure 5:
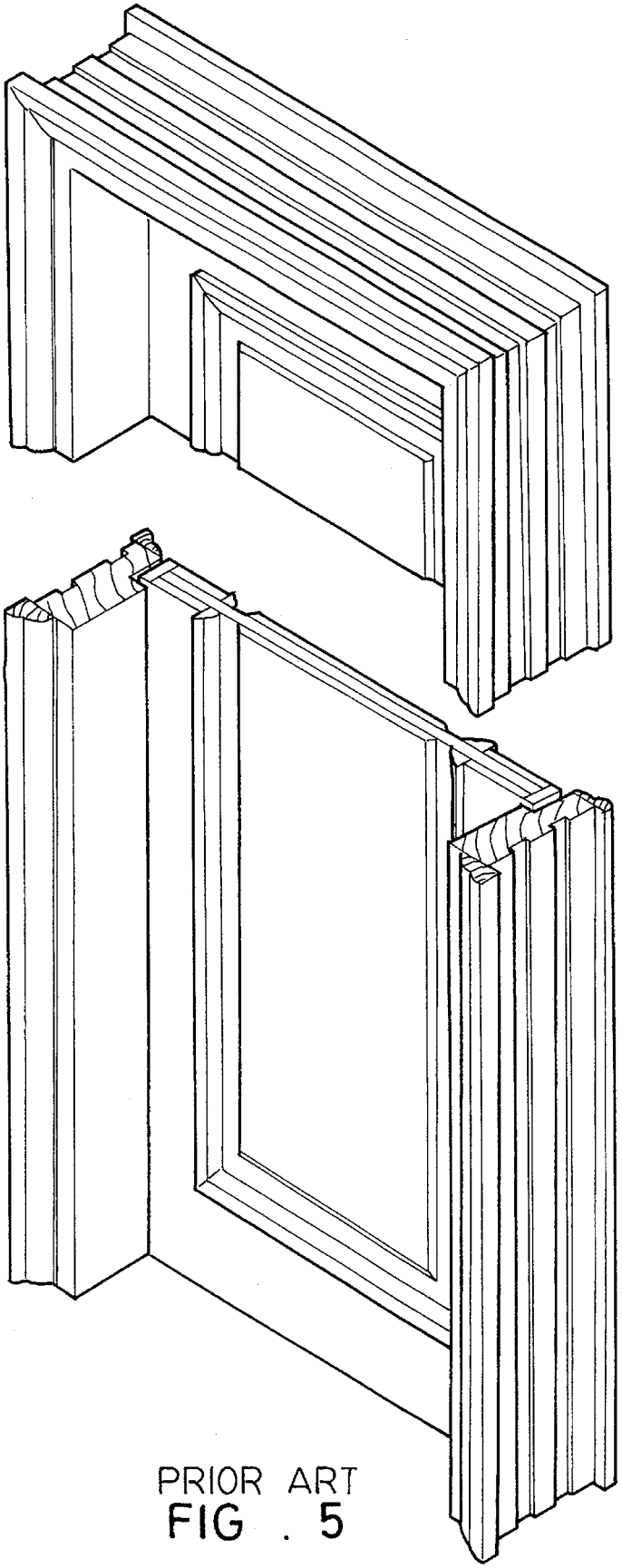
PRIOR ART FIG . 5
FIG. 5 illustrates a fifth prior art door.

For the purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 6:
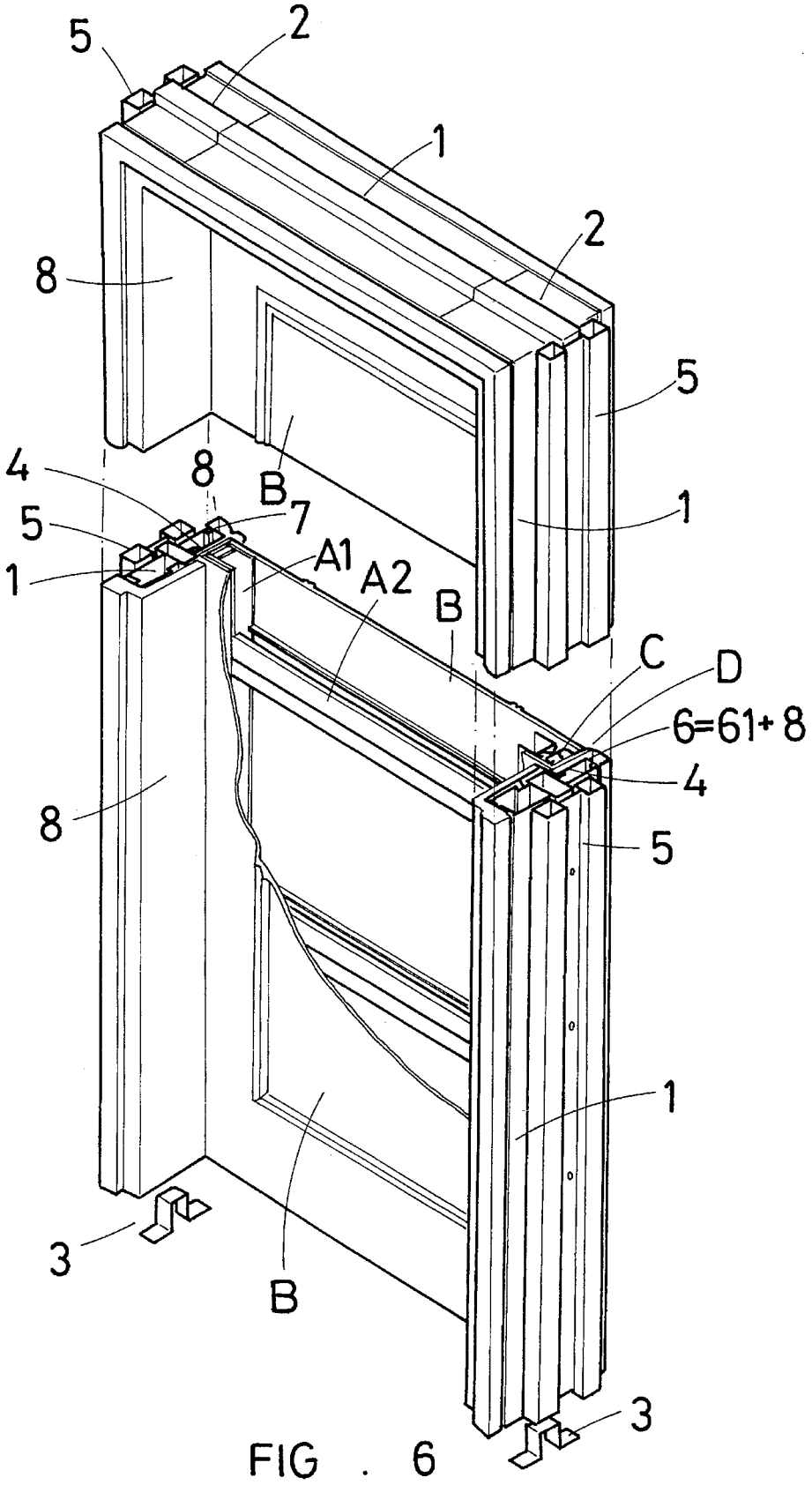
FIG. 6 is a perspective view of the present invention.
Figure 7:
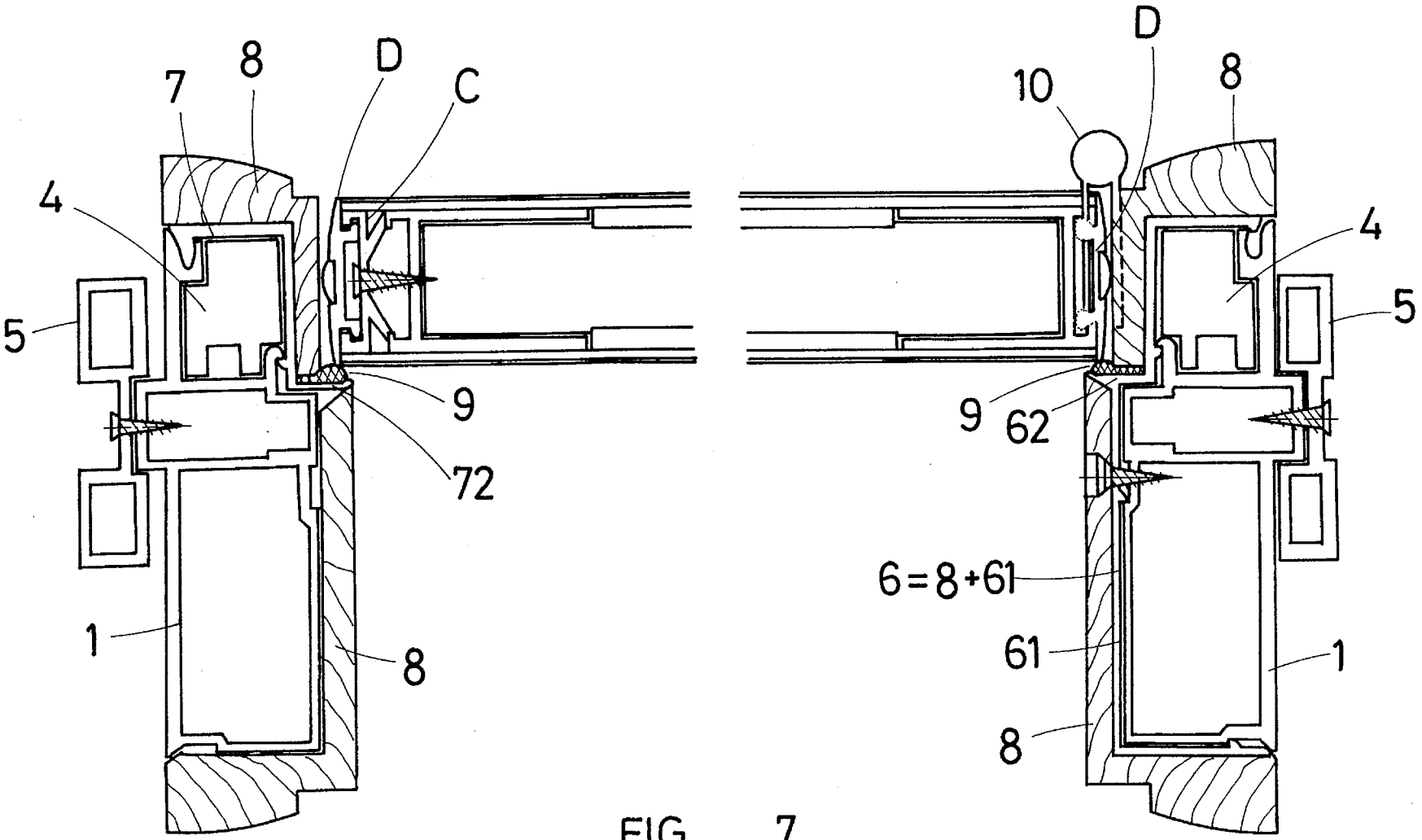
FIG. 7 is a sectional view of the present invention.

With reference to the drawings and in particular to FIGS. 6 and 7, the door frame according to the present invention mainly comprises rails 1, right-angled connectors 2, auxiliary locking members 4, fastening posts 5 and covering members 6.

Figure 8:
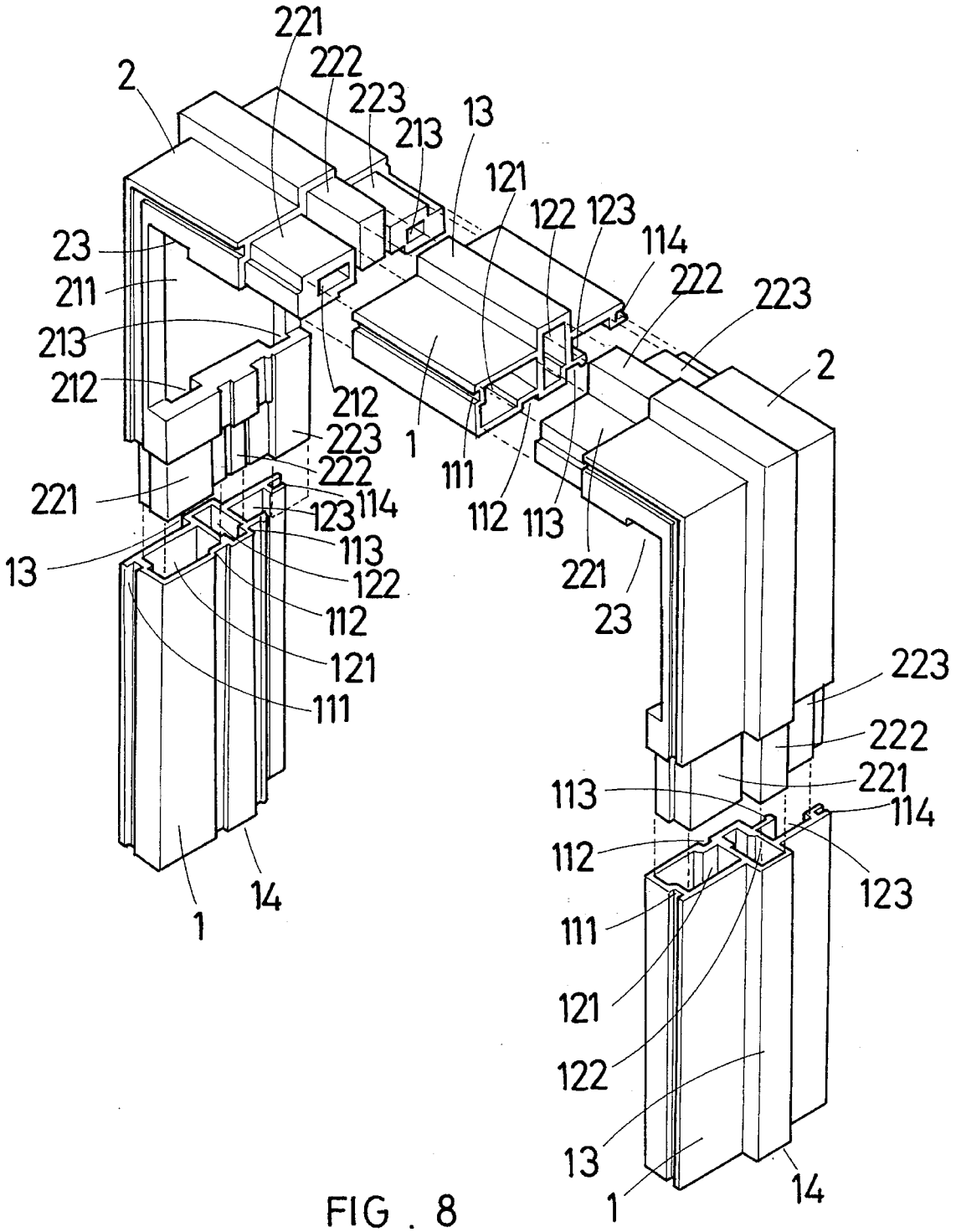
FIG. 8 is an exploded view of the present invention.

As shown in FIG. 8, one of the rails 1 is used as the top rail, while the other two as the left and right side rails respectively. The rail 1 is formed with a first passage 121 at the left side, a second passage 122 at the intermediate portion, a third passage 123 at the right side, a first slot 111 at the left edge, a second slot 112 at the front side, a third slot 113 at the front side, a fourth slot 114 at the right edge, and a raised portion 13 at the rear side. The right-angled connector 2 is formed with a left shoulder 221, a central block 222 and a right shoulder 223 which are adapted to be inserted into the first passage 121, the second passage 122 and the third passage 123 of the rail 1 respectively. Hence, an inverted U-shaped frame can be easily set up by connecting the three rails 1 with two right-angled connectors 2. The inner side of the right-angled connector 2 has a recess 211 and two holes 212 and 213 for the passage of electrical wires (not shown).

Figure 9:
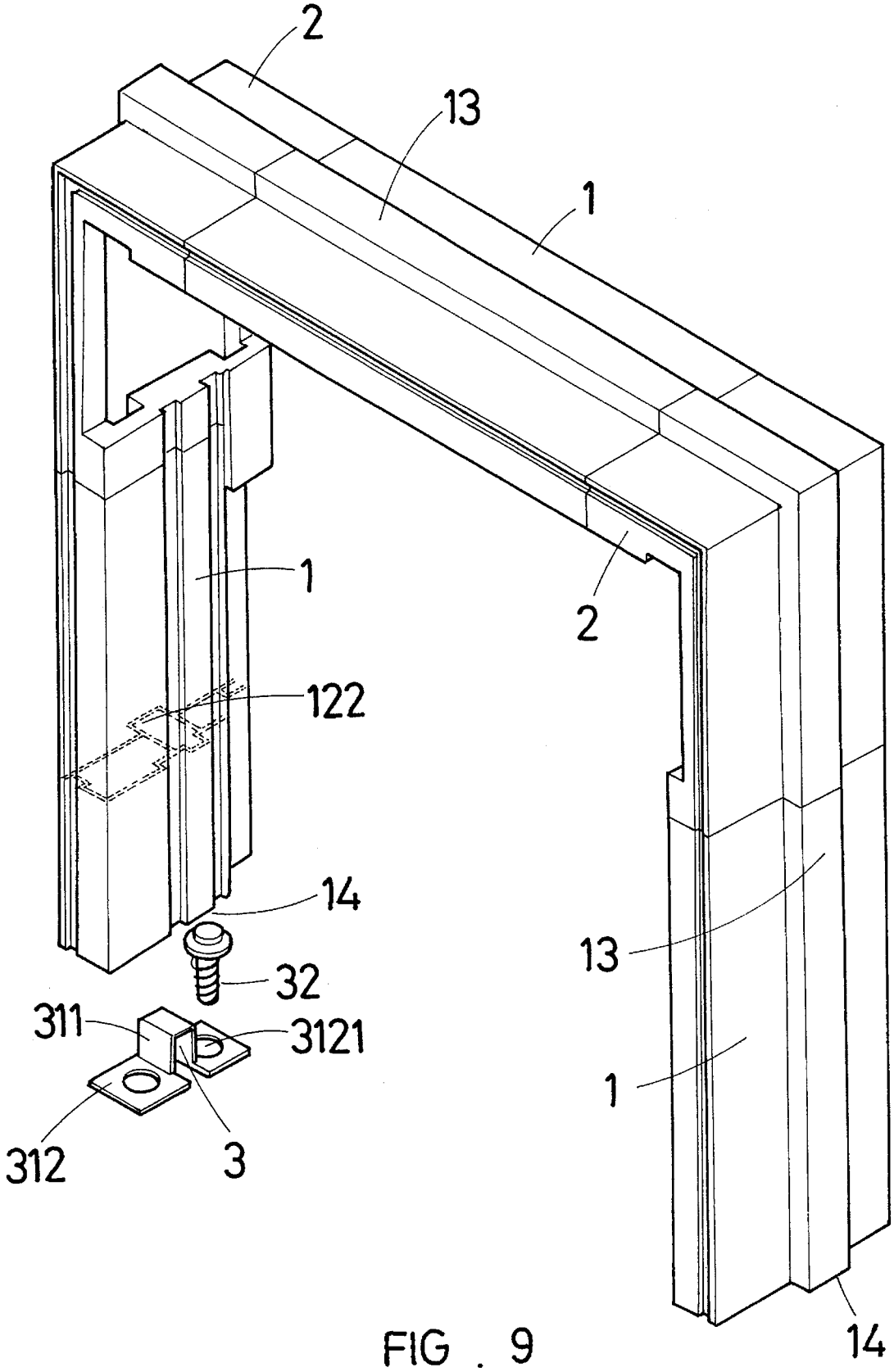
FIG. 9 shows the engagement between the supporter and the lower end of the inverted U-shaped frame.

Referring to FIG. 9, the lower ends of the inverted U-shaped frame are supported by two supporters 3. The supporter 3 has a projection 311 at the intermediate portion and a lug 312 at both side portions and is adapted to engage with the lower end of the inverted U-shaped frame. The lug 312 of the supporter 3 has a circular hole 3121 so that the supporter 3 can be fixedly mounted on the ground by screws 32.

Figure 10:
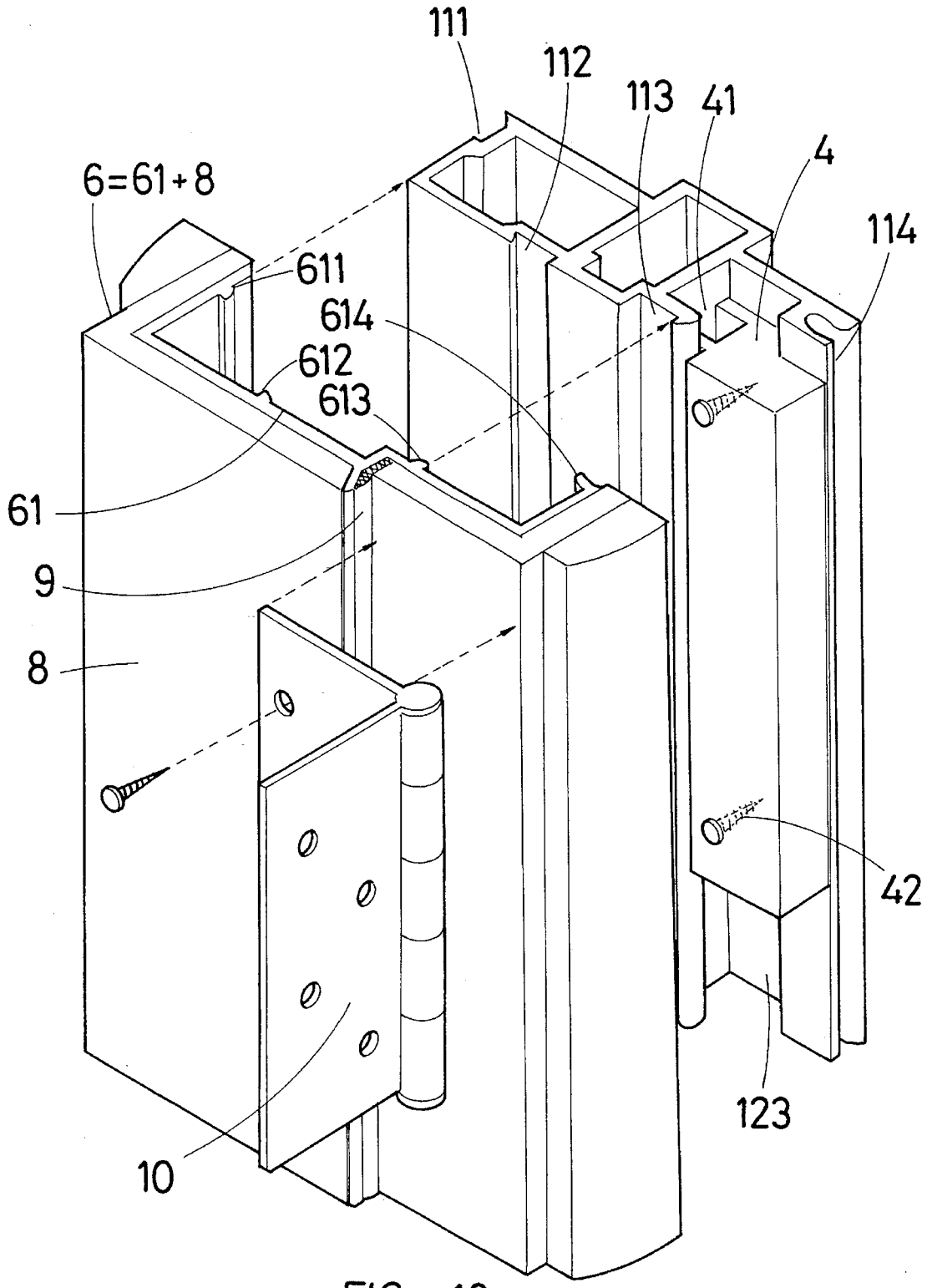
FIG. 10 shows the connection between the auxiliary locking member and the rail.

Looking now at FIG. 10, the auxiliary locking member 4 is fixedly installed into the passage 123 of the rail 1 by screws 42. The auxiliary locking member 4 has a slot 41 for the passage of electrical wires (not shown).

Figures 11, 11A:
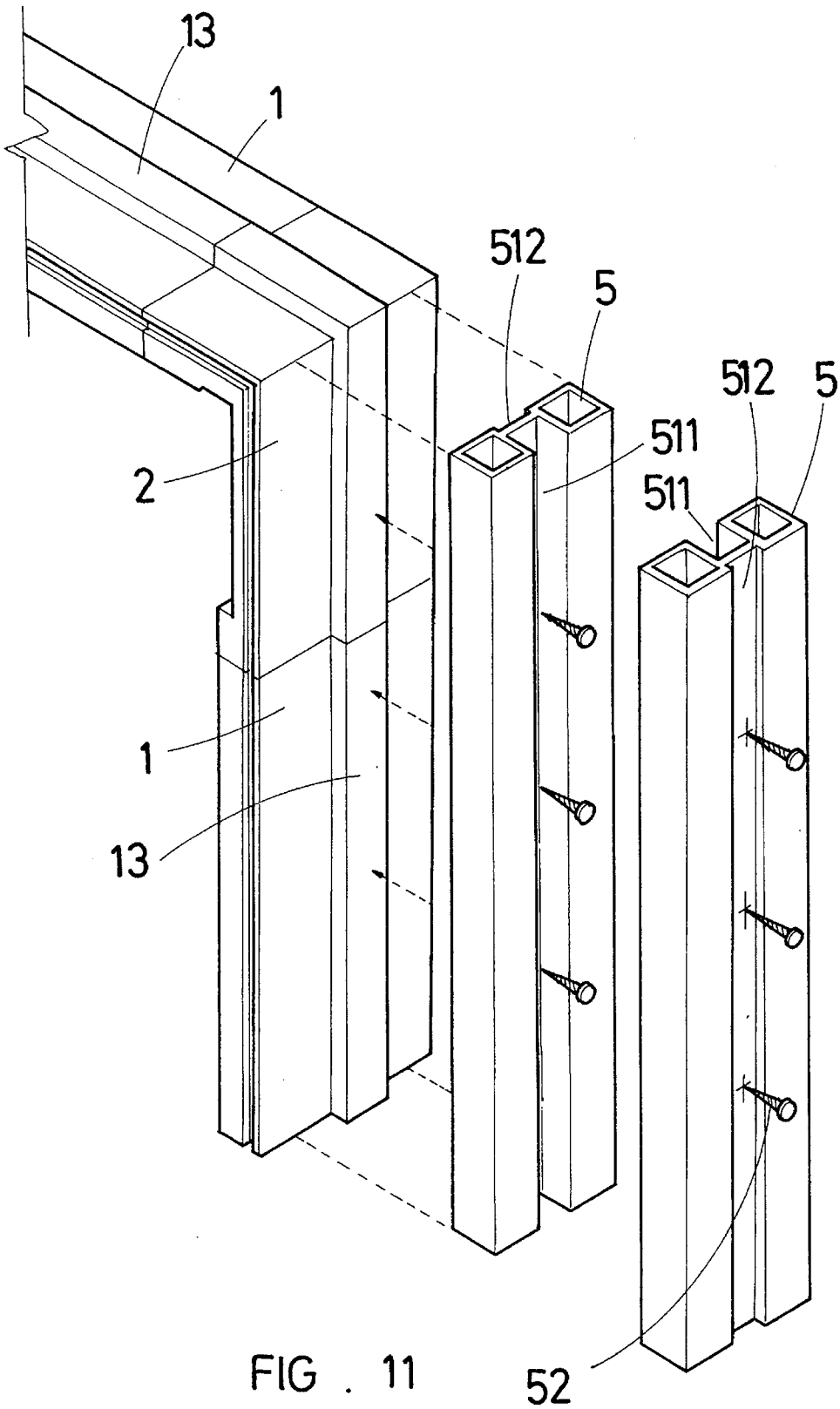
FIG. 11 illustrates how to engage the fastening post with the frame.
FIG. 11A illustrates another side of the fastening post.

As illustrated in FIGS. 11 and 11A, the fastening post 5 is formed with a first groove 511 at one side and a second groove 512 at the opposite side. The first groove 511 and the second groove 512 are of different depths and adapted to be fixed on the raised portion 13 of the inverted U-shaped frame by screws 52. The frame may be engaged with the first or second groove 52 of the fastening post 5 as required. The fastening post 5 may be made of alloy, fiber reinforced plastic or the like.

Figures 12, 12A:
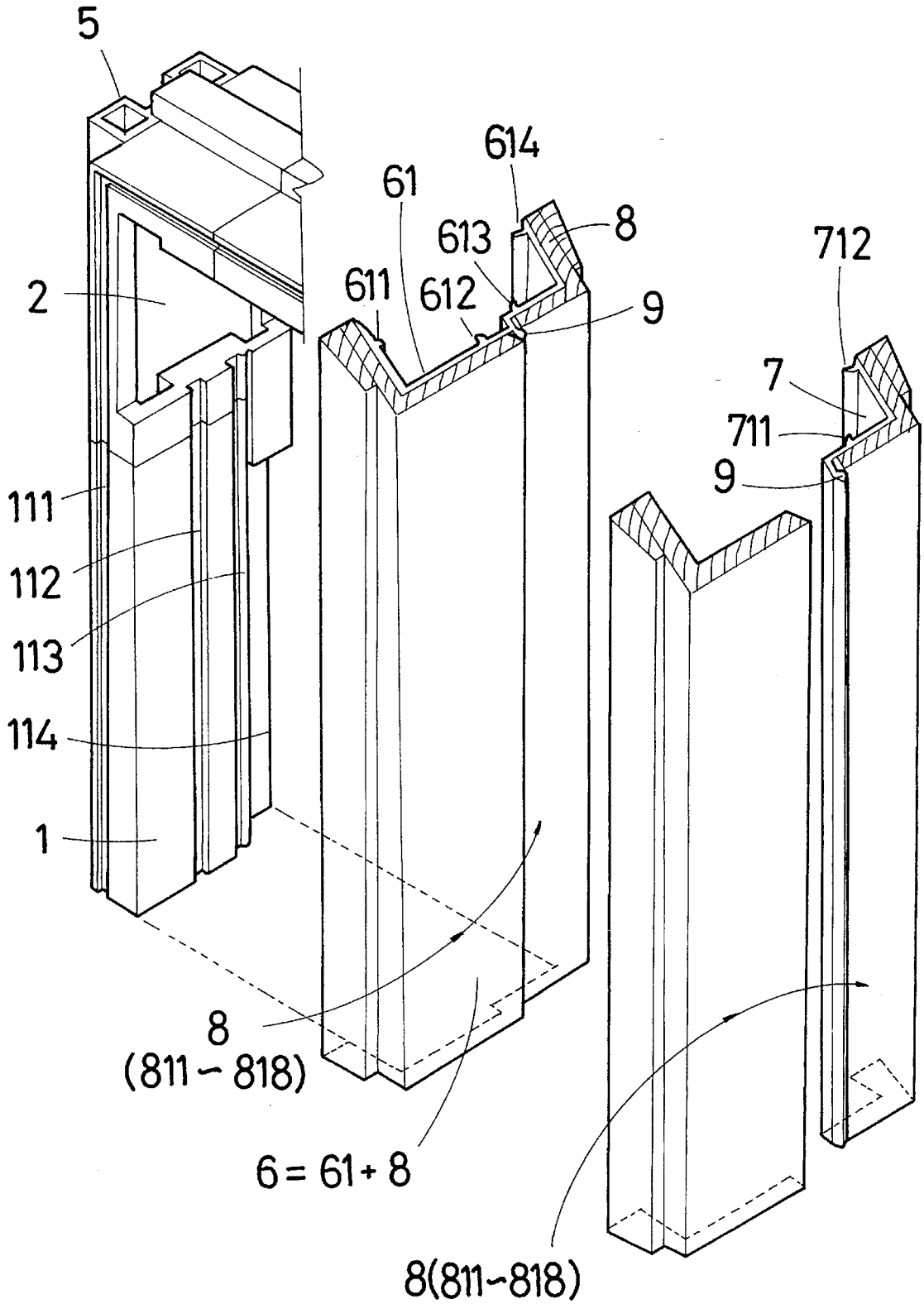
FIG. 12 illustrates how to engage the covering member with the frame.
FIG. 12A is an exploded view of the covering member.
Figure 13:
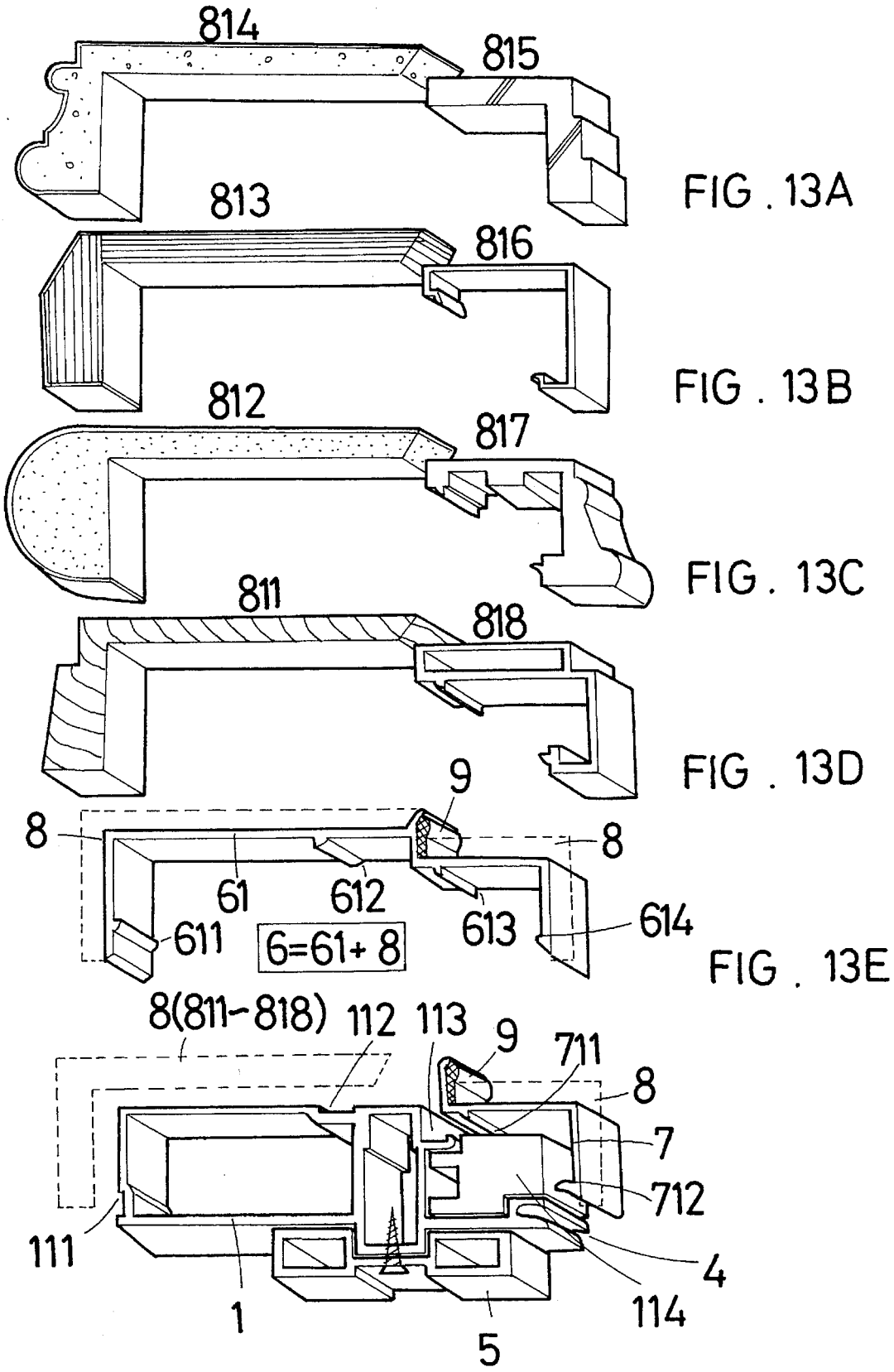
FIG. 13 illustrates how to engage a covering member with the rail.

Referring to FIGS. 12 and 12A, the covering member 6 includes a base member 61 made of alloy of fiber reinforced plastic and a housing 8 fixedly mounted thereon. The inner side of the covering member 6 is provided with elongated protuberances 611, 612, 613 and 614 adapted to be engaged with the slots 111, 112, 113 and 114 of the rail 1.

As shown in FIGS. 13, 13A, 13B, 13C, 13D and 13E, the frame may be directly engaged with any surface materials 811, 812, 813, 814, 815, 816, 817 or 818. A rear covering member 7 is engaged with the rail 1, with its hook-like projections 711 and 712 engaged with the slots 113 and 114 of the rail 1.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A structure of a door frame comprising:

four rails each formed with a first passage at one side, a second passage at an intermediate portion, a third passage at another side, a first slot at an edge, a second slot at a front side, a third slot at the front side, a fourth slot at another side, and a raised portion at a rear side;

four right-angled connectors formed with a first shoulder at one side, a central block, and a second shoulder at another side adapted to be inserted into said first, second and third passages;

auxiliary locking members each fixedly installed into said third passage and having a slot for passage of electrical wires;

four fastening posts each formed with a first groove at one side and a second groove at another side adapted to engage with the raised portion of said rails and right-angled connectors; and covering members arranged on inner sides of said rails and right-angled connectors.

* * * * *